US008092232B2

(12) United States Patent
Takeuchi

(10) Patent No.: US 8,092,232 B2
(45) Date of Patent: Jan. 10, 2012

(54) BOARD-TO-BOARD CONNECTOR

(75) Inventor: Ryotaro Takeuchi, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/643,907

(22) Filed: Dec. 21, 2009

(65) Prior Publication Data

US 2010/0159717 A1 Jun. 24, 2010

(30) Foreign Application Priority Data

Dec. 19, 2008 (JP) ..... 2008-323131

(51) Int. Cl.
*H01R 12/00* (2006.01)

(52) U.S. Cl. ..... 439/74

(58) Field of Classification Search ..... 439/74
See application file for complete search history.

(56) References Cited

U.S. PATENT DOCUMENTS

| | | | | |
|---|---|---|---|---|
| 7,344,387 | B2 * | 3/2008 | Shiroyama | 439/74 |
| 7,402,054 | B2 * | 7/2008 | Peng et al. | 439/74 |
| 7,637,786 | B2 * | 12/2009 | Hoshino et al. | 439/660 |
| 7,717,719 | B2 * | 5/2010 | Miyazaki et al. | 439/74 |
| 7,845,987 | B2 * | 12/2010 | Yamada et al. | 439/680 |

* cited by examiner

*Primary Examiner* — Truc Nguyen
(74) *Attorney, Agent, or Firm* — Timothy M. Morella

(57) ABSTRACT

A board-to-board connector is disclosed. The connector has first and second connectors. The first connector has concave insertion portions in which first terminals are arranged. The second connector is configured to be engaged, by fitting, with the first connector. The second connector has convex insertion portions in which second terminals are arranged and which are inserted in the concave insertion portions.

7 Claims, 12 Drawing Sheets

BOARD-TO-BOARD CONNECTOR

REFERENCE TO RELATED APPLICATIONS

The Present Disclosure claims priority to Japanese Patent Application No. 2008-323131, entitled "Board-To-Board Connector," and filed 19 Dec. 2009, the contents of which is fully incorporated in its entirety herein.

BACKGROUND OF THE PRESENT DISCLOSURE

The Present Disclosure relates generally to board-to-board connectors, and, more particularly, a board-to-board connector configured so that when a second terminal of a second connector is positioned between a two contact portions of a first terminal of a first connector, a mutual gap between the contact portions is increased by the pressing of the second terminal, and is then decreased, so that a discernable click-feeling can be perceived.

Board-to-board connectors have been used to electrically connect a pair of parallel circuit boards with each other. Such a connector is attached, by tight fitting, to respective opposing surfaces of the pair of circuit boards so that the circuit boards are electrically connected.

One example of such a connector is illustrated in Japanese Patent Application Laid-Open (Kokai) No. 2005-203139). FIG. 14 illustrates a cross-sectional view of a conventional board-to-board connector. Referring to FIG. 14, first housing 811 is a housing of a first connector mounted in first circuit board 891, and second housing 911 is a housing of a second connector mounted in second circuit board 991. When the first connector and the second connector are engaged together by fitting, first circuit board 891 and second circuit board 991 are coupled.

First housing 811 is provided with concave hollow portion 812 in which first terminals 861 are mounted. Each first terminal 861 is provided with tail portion 862, soldered to a connection pad of first circuit board 891 and contact portion 865, and engaging shoulder portion 864, configured to make contact with respective second terminals 961 of the second connector.

Similarly, in second housing 911, second terminals 961 are mounted. Each second terminal 961 is provided with tail portion 962, soldered to a connection pad of second circuit board 991 and contact portion 965, and engaging projection portion 964, configured to make contact with respective first terminals 861 of the first connector.

As will be understood, when the first and second connectors are engaged together by fitting, contact portion 865 of each first terminal 861 contacts with contact portion 965 of each second terminal 961, and engaging shoulder portion 864 of each first terminal 861 engages engaging projection portion 964 of each second terminal 961. As a result, first and second terminals 861, 961 are electrically connected to each other. Moreover, when engaging shoulder portion 864 is engaged with engaging projection portion 964, engaging projection portion 964 sinks into engaging shoulder portion 864, thereby producing a click-feeling, so that an operator is able to perceive that the fitting engagement between the first and second connectors is completed. Further, since engaging shoulder portion 864 and engaging projection portion 964 function as a lock mechanism, first and second terminals 861, 961 are held in a locked state, so that reliable fitting engagement between the first and second connectors is achieved.

However, in the conventional board-to-board connector, since the click-feeling is produced in response to sinking of engaging projection portion 964 into engaging shoulder portion 864, the click-feeling may not be strong enough to be perceived by the operator.

When the first and second connectors are engaged together by fitting, since the connectors are mounted on surfaces of first and surface second circuit boards 891, 991 which have a large area, there is often a case where the operator is requested to perform a fumbling operation for fitting in a state of being unable to visually recognize fitting faces of first and second housings 811, 911. In such a case, the operator has to rely on the click-feeling to determine whether or not the fitting engagement between the first and second connectors is completed since he is unable to visually recognize the completion of the fitting engagement between the first and second connectors. Thus, if the click-feeling is not perceived, the fitting operation is continued even when the fitting engagement is completed, thereby wasting time.

SUMMARY OF THE PRESENT DISCLOSURE

Therefore, it is an object of the Present Disclosure to obviate the above-described problems by providing a board-to-board connector configured so that when a second terminal of a second connector is positioned between a two contact portions of a first terminal of a first connector, a mutual gap between the contact portions is increased by the pressing of the second terminal, and is then decreased, so that a discernable click-feeling can be perceived. Even when a fitting operation of the connectors is performed in a fumbling manner, an operator is able to certainly recognize the completion of fitting engagement. As a result, the fitting operation can be completed in a short period of time and in an accurate manner. Accordingly, it is possible to provide good operability and high reliability for the board-to-board connector.

Therefore, in accordance with the Present Disclosure, a board-to-board connector is provided which comprises: a first connector having concave insertion portions in which first terminals are arranged; and a second connector configured to be engaged, by fitting, with the first connector, the second connector having convex insertion portions in which second terminals are arranged and which are inserted in the concave insertion portions, wherein: each of the first terminals is provided with a first contact portion which is arranged on one side face of each of the concave insertion portions and a second contact portion which is arranged on the other side face of each of the concave insertion portions; each of the second terminals is provided with a first contact portion which is arranged on one side face of each of the convex insertion portion so as to extend in an insertion direction of the convex insertion portions and is configured to make contact with the first contact portion of each of the first terminals and a second contact portion which is arranged on the other side face of each of the convex insertion portions so as to extend in the insertion direction of the convex insertion portions and is configured to make contact with the second contact portion of each of the first terminals; and when the convex insertion portions are inserted in the concave insertion portions, a mutual gap between the first contact portion and the second contact portion of each of the first terminals is increased due to pressing of respective one of the second terminals and is then decreased.

In accordance with another embodiment of the Present Disclosure, the board-to-board connector has such a configuration that either one of the first contact portion and the second contact portion of each of the second terminals is provided with a convex contact portion which is configured to protrude from a surface thereof, and the other contact portion is provided with a concave contact portion which is configured to be recessed from a surface thereof.

In accordance with a further embodiment of the Present Disclosure, the board-to-board connector has such a configuration that when the convex insertion portions are inserted in the concave insertion portions, a timing at which any one of the first contact portion and the second contact portion of each of the first terminal reaches a starting end portion of the concave contact portion takes place at the same time with or immediately after a timing at which the other contact portion reaches an extreme end portion of the convex contact portion.

In accordance with a still further embodiment of the Present Disclosure, the board-to-board connector has such a configuration that an insertion force needed when the convex insertion portions are inserted in the concave insertion portions increases and then decreases abruptly in response to the mutual gap between the first contact portion and the second contact portion of each of the first terminals, which is increased due to pressing and is then decreased.

In accordance with a still further embodiment of the Present Disclosure, the board-to-board connector has such a configuration that an insertion force needed when the convex insertion portions are inserted in the concave insertion portions decreases from its maximum value when any of the first contact portion and the second contact portion of each of the first terminals passes the extreme end portion of the convex contact portion.

In accordance with the Present Disclosure, the board-to-board connector has such a configuration that when the respective one of the second terminals of the second connector is inserted to be positioned between the first contact portion and the second contact portion of each of the first terminals of the first connector, the mutual gap between the first contact portion and the second contact portion is increased by pressing and is then decreased. Owing to such a configuration, since a strong click-feeling can be perceived, even when a fitting operation of the connectors is performed in a fumbling manner, an operator is able to certainly recognize the completion of fitting engagement. Therefore, the fitting operation can be completed in a short period of time and in an accurate manner. Accordingly, it is possible to provide good operability and high reliability for the board-to-board connector.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
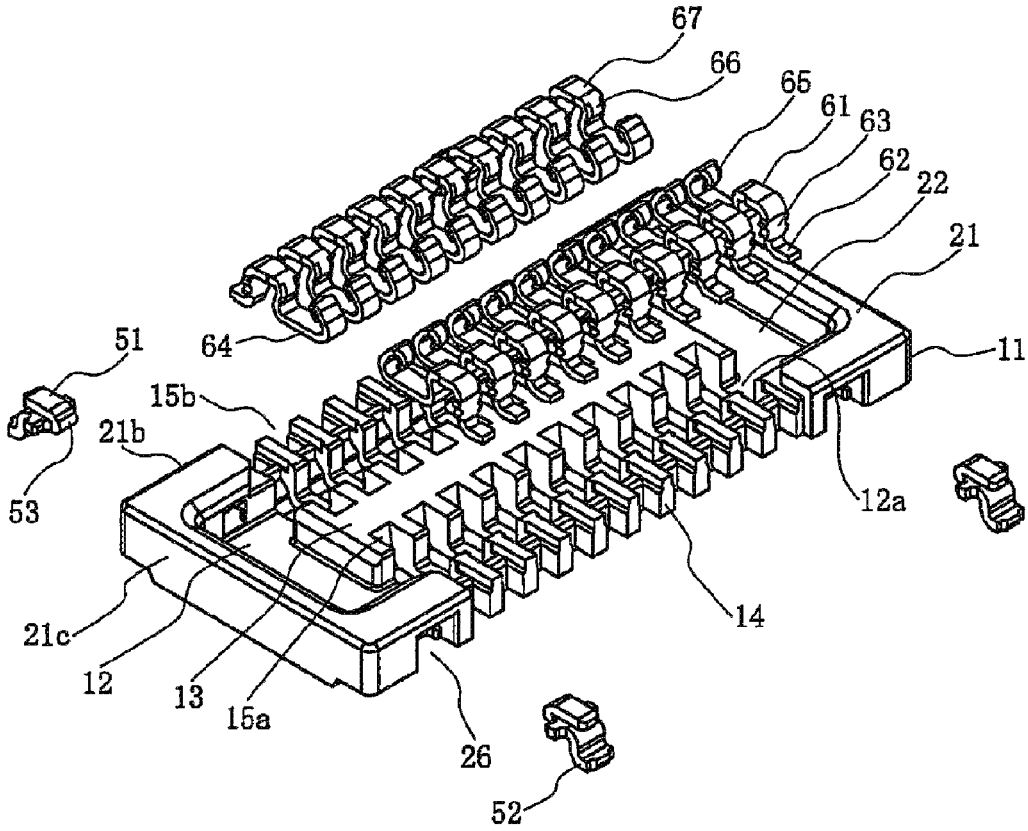
FIG. 1 is an exploded view of a first connector of a board-to-board connector according to an embodiment of the Present Disclosure, as viewed from a fitting face thereof.
Figure 2:
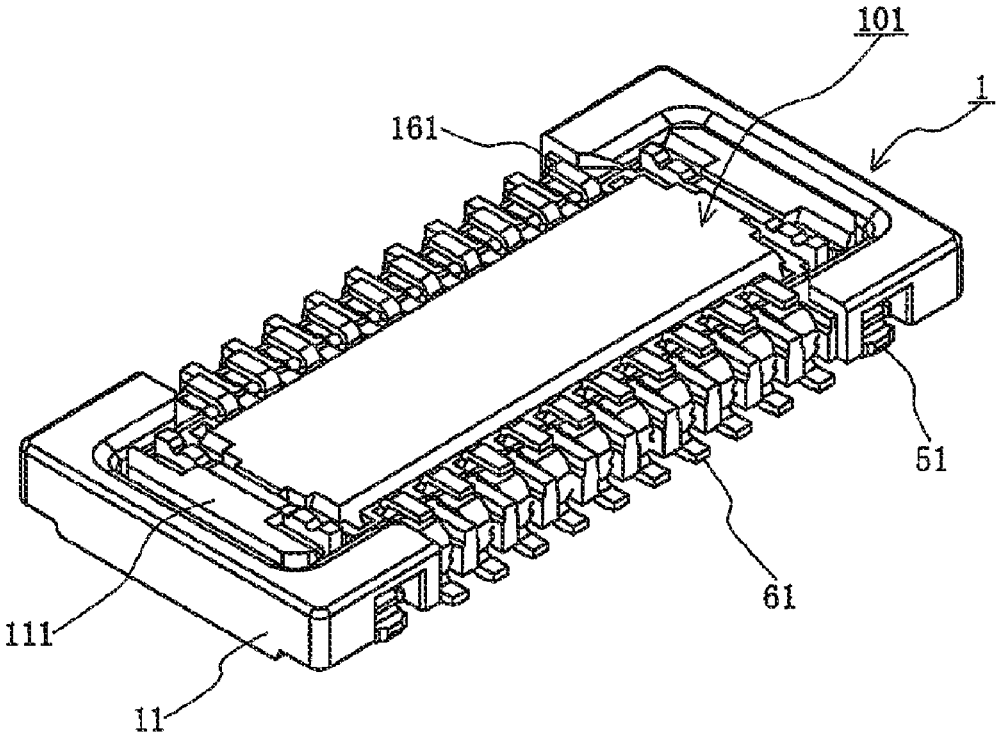
FIG. 2 is a perspective view of first and second connectors of the board-to-board connector according to the embodiment of the Present Disclosure, illustrating a state where the connectors are engaged together by fitting, as viewed from a fitting face of the first connector.

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front, rear and the like, used for explaining the structure and movement of the various elements of the Present Disclosure, are not absolute, but relative. These representations are appropriate when the elements are in the position shown in the Figures. If the description of the position of the elements changes, these representations are to be changed accordingly.

Referring to FIGS. 1-5, first connector 1, as one of a pair of board-to-board connectors according to the Present Disclosure, is a surface-mounted type connector is mounted on a surface of a non-illustrated first printed circuit board. Moreover, second connector 101, as the other of the pair of board-to-board connectors, is a surface-mounted type connector, which is mounted on a surface of a non-illustrated second printed circuit board. The board-to-board connector of the Present Disclosure includes first connector 1 and second connector 101, and is configured to electrically connect the first and second printed circuit boards together.

First connector 1 preferably includes first housing 11, as a connector body integrally formed of an insulating material. As illustrated, first housing 11 is a generally rectangular parallelepiped member having a generally rectangular, thick plate-like shape. Concave portion 12, having a generally rectangular shape having a surrounded perimeter, is formed on a side, i.e., a fitting side (the upper side in FIG. 2), where second connector 101 is fitted. Moreover, first protrusive convex portion 13, as an island portion, is formed in concave portion 12 to be integral with first housing 11. Furthermore, side wall portions 14, configured to extend in parallel to first protrusive convex portion 13, are formed at both sides of first protrusive convex portion 13, integral with first housing 11. In this case, first protrusive convex portion 13 and side wall portions 14 protrude upwardly from the bottom portion of concave portion 12 and extend in the longitudinal direction of first housing 11. Owing to this configuration, recessed groove portions 12*a*, as a portion of concave portion 12, being elongated concave insertion portions configured to extend in the longitudinal direction of first housing 11, are formed at both sides of first protrusive convex portion 13 to be disposed between first protrusive convex portion 13 and side wall portions 14. Although in the illustrated example, first protrusive convex portion 13 is singular in number, a plurality of first protrusive convex portions 13 may be provided.

In this embodiment, first terminal-receiving inside cavities 15*a*, having a recessed groove shape, are formed on both side surfaces of first protrusive convex portion 13. Moreover, first terminal-receiving outside cavities 15*b*, also having a recessed groove shape, are formed along an upper surface and both side surfaces of each side wall portion 14. Further, first terminal-receiving cavities 15*a*, 15*b* are connected at a bottom portion of recessed groove portion 12*a* and are integral with each other.

First terminals 61 are an integral member formed, by applying, e.g., punching and bending, to a conductive metallic plate. Each first terminal 61 is provided with holding portion 63, tail portion 62 connected to a lower end of holding portion 63, upper connection portion 67 connected to an upper end of holding portion 63, second contact portion 66 formed in the vicinity of an inner end of upper connection portion 67, lower connection portion 64 connected to second contact portion 66, and first contact portion 65 formed in the vicinity of a free end of lower connection portion 64.

Holding portions 63 are portions that extend in the up-down direction, i.e., in the thickness direction of first housing 11, to be held by being fitted in first terminal-receiving outside cavities 15*b*. Tail portions 62 are bent to be connected to holding portions 63 and extend in the left-right direction, i.e., outwardly in the width direction of first housing 11, to be connected to connection pads connected to a conductive trace on the first board. Upper connection portions 67 are bent to be connected to holding portions 63 and extend inwardly in the width direction of first housing 11.

Figure 5:
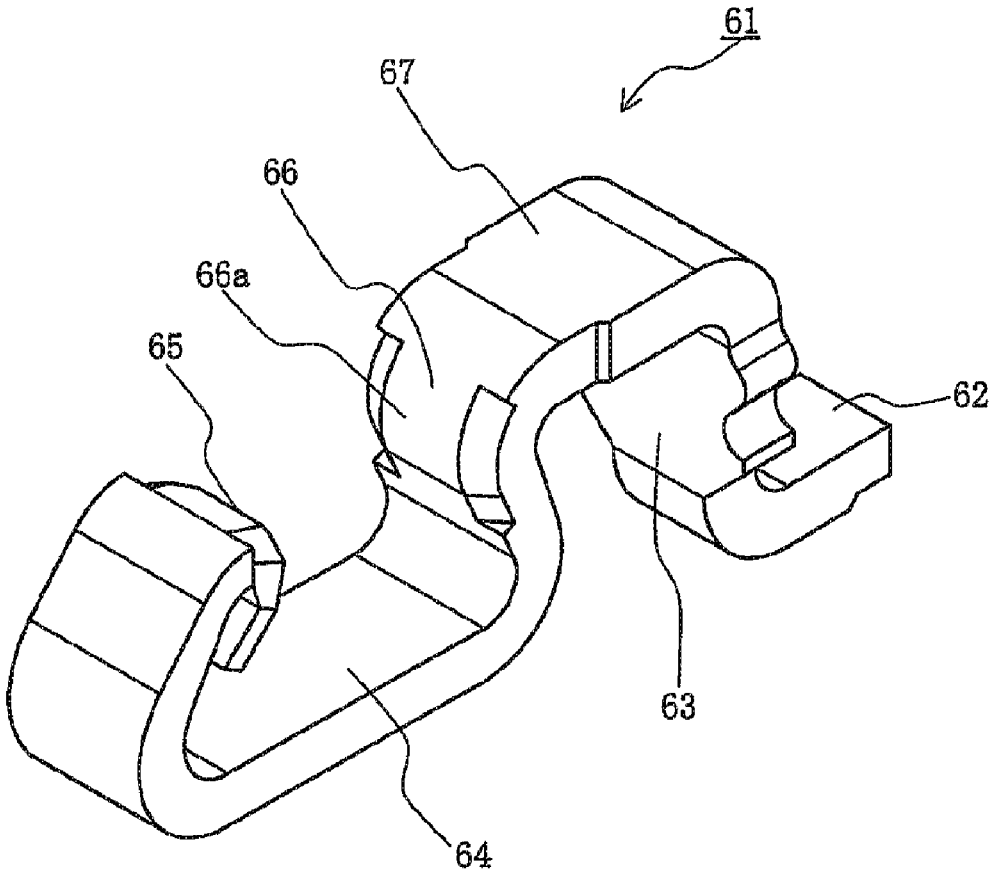
FIG. 5 is a second perspective view of the first terminal of FIG. 4.
Figure 6:
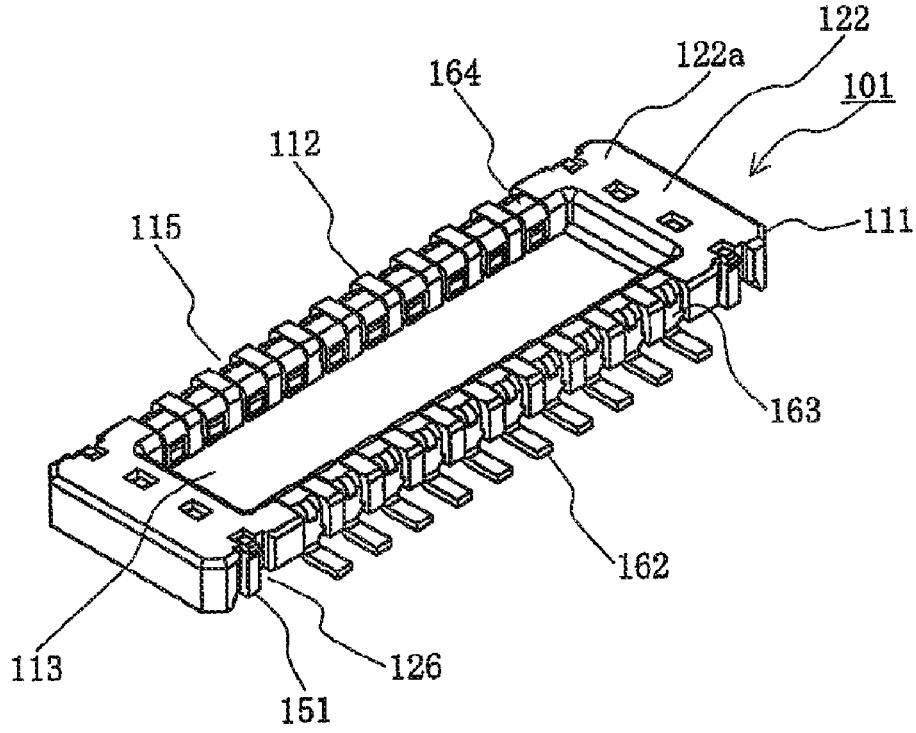
FIG. 6 is a perspective view of the second connector of FIG. 2, as viewed from a fitting face thereof.
Figure 7:
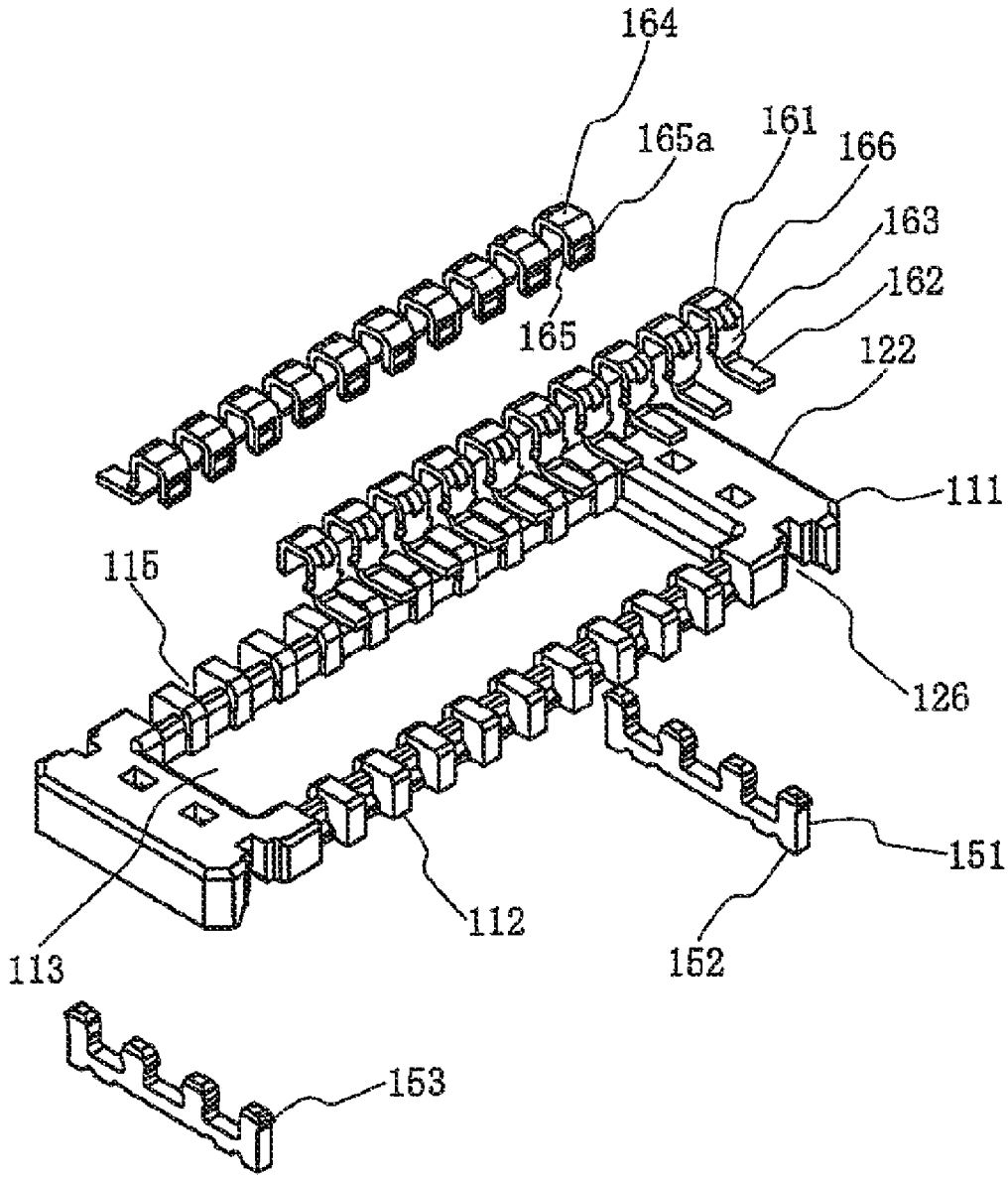
FIG. 7 is an exploded view of the second connector of FIG. 6.

Second contact portions 66, having a curved shape and configured to downwardly bend and protrude toward the inner side in the width direction of first housing 11, are formed at the inner ends of upper connection portions 67. Moreover, as illustrated in FIG. 5, portions of second contact portions 66 which protrude outermost toward the inner side are second convex contact portions 66*a*. Lower connection portions 64 are portions, which have a generally U shape in side view, and are connected to the lower ends of second contact portions 66.

Figure 4:
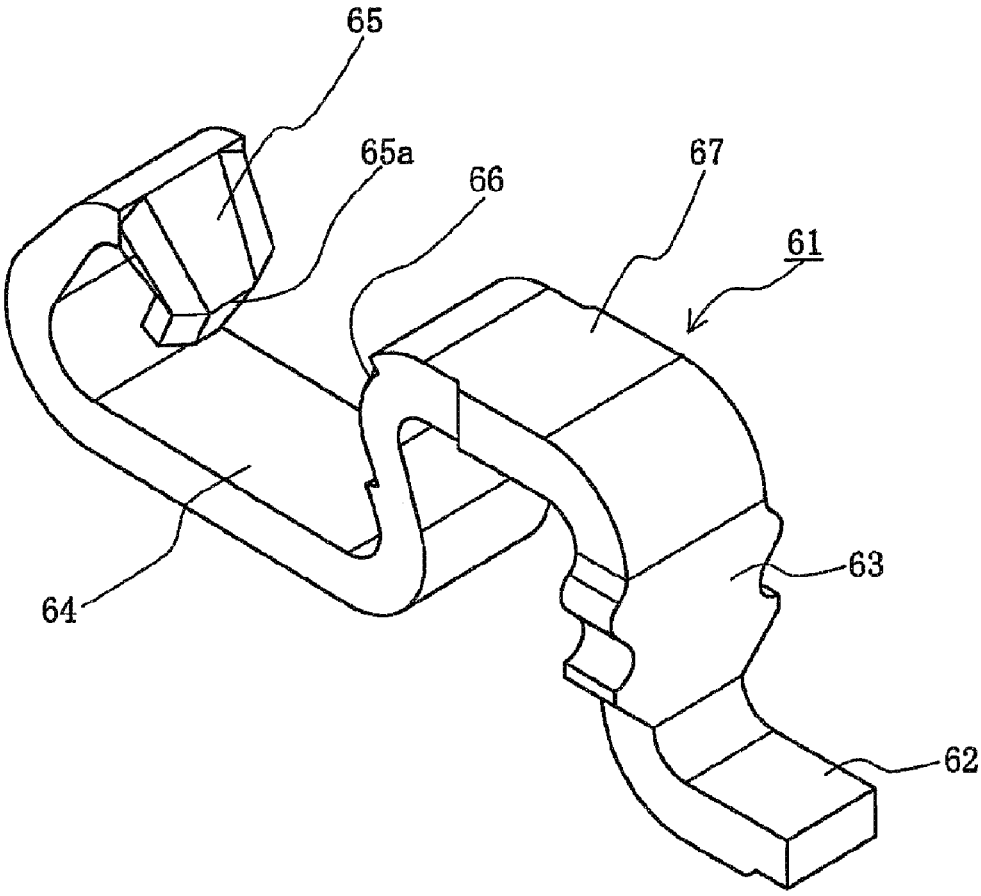
FIG. 4 is a first perspective view of the first terminal of the board-to-board connector according to the embodiment of the Present Disclosure.

Further, first contact portions 65, having a curved shape and configured to bend in a U shape and protrude toward the outer side in the width direction of first housing 11, are formed at the free ends, i.e., in the vicinity of the inner upper ends, of lower connection portions 64. Moreover, as illustrated in FIG. 4, portions of first contact portions 65 which protrude outermost toward the outer side are first convex contact portions 65*a*.

First terminals 61 are fitted into first terminal receiving cavities 15 from the fitting side to be secured to first housing 11 when holding portions 63 are clamped by the side walls of first terminal-receiving outside cavities 15*b* in a sandwich manner, which are disposed outside side wall portions 14. In this state, where first terminals 61 are mounted in first housing 11, first and second contact portions 65, 66 are positioned on both left and right sides of recessed groove portion 12*a* so as to oppose each other. Moreover, a distance, namely a gap, between first and second contact portions 65, 66 is defined by a gap between the respective ones of first and second convex contact portions 65*a*, 66*a* which are the most protruding portions, respectively.

Since first terminals 61 are formed by applying processing to a metal plate, they have some degree of elasticity. Moreover, as is obvious from the shape of the first terminals, the gap between the opposing ones of first and second contact portions 65, 66 is elastically changeable. That is, when second terminals 161 of second connector 101 are inserted to be positioned between first and second contact portions 65, 66, the gap between first and second contact portions 65, 66 is elastically increased.

Further, first protrusive end portions 21, as a first fitting guide portion, are arranged at both ends in the longitudinal direction of first housing 11. Concave protrusive end portion 22, a portion of concave portion 12, is formed in each first protrusive end portion 21. Concave protrusive end portions 22 are generally rectangular concave portions connected to both ends in the longitudinal direction of each recessed groove portion 12*a*. Moreover, concave protrusive end portions 22 function as a concave guide portion in which second protrusive end portion 122 of second connector 101 is inserted when first and second connector 1, 101 are engaged.

Each first protrusive end portion 21 is provided with flat upper surface 21*a*, sidewall extension portions 21*b*—configured to extend in the longitudinal direction of first housing 11 from both ends in the longitudinal direction of side wall portion 14, and end wall portion 21*c*—configured to extend in the short-axis direction of first housing 11 and having both ends thereof connected to sidewall extension portions 21*b*. In each first protrusive end portion 21, end wall portion 21*c* and sidewall extension portions 21*b* connected to both ends of end wall portion 21*c* form a continuous side wall having an inverted C shape to thereby define three sides of rectangular concave protrusive end portion 22.

Further, first reinforcing brackets 51 are attached to first protrusive end portions 21. First reinforcing brackets 51 are formed by applying processing, e.g., punching and bending, to a metal plate and are received and held in first concave bracket holding portions 26 formed in sidewall extension portions 21*b*. Moreover, tail portions 52, formed at the lower ends of first reinforcing brackets 51, are connected (such as by soldering) to fixing pads on the first board. Further, convex engagement portions 53, formed at the upper ends of first reinforcing brackets 51, are configured to protrude from the inner side surfaces of one sidewall extension portion 21*b* to be received in concave protrusive end portions 22, so as to be engaged with second reinforcing brackets 151 of second connector 101 when first and second connectors 1, 101 are engaged.

Referring to FIGS. 6-9, second connector 101 includes second housing 111 as a connector body integrally formed of an insulating material. As illustrated, second housing 111 is a generally rectangular parallelepiped member having a generally rectangular, thick plate-like shape. Moreover, elongated recessed cavity portion 113, configured to extend in the longitudinal direction of second housing 111, and second protrusive convex portions 112, configured to define the outer sides of recessed cavity portion 113 and extend in the longitudinal direction of second housing 111, are integrally formed on a side, i.e., a fitting side (the upper side in FIG. 6) of second housing 111 when first connector 1 is fitted. Second protrusive convex portions 112 are formed along both sides of recessed cavity portion 113 and of second housing 111. Moreover, second terminals 161 are arranged in each second protrusive convex portion 112.

As illustrated, recessed cavity portion 113 is closed by a bottom portion at a surface thereof on a side, i.e., a mounting surface (the lower surface in FIG. 6) when mounted on the second board. Moreover, second terminal receiving cavities 115 are formed along both side surfaces and an upper surface of second protrusive convex portion 112, so that second terminals 161 are received in second terminal receiving cavities 115.

Second terminals 161 are an integral member formed by processing, e.g., punching and bending, to a conductive metal plate. Each second terminal 161 is provided with holding portion 163 also functioning as a second contact portion, tail portion 162 connected to a lower end of holding portion 163, connection portion 164 connected to an upper end of holding portion 163, and first contact portion 165 connected to an inner end of connection portion 164.

Holding portions 163 are portions that extend in the up-down direction, i.e., in the thickness direction of second housing 111, held by being fitted in second terminal receiving cavities 115 and contacting second contact portions 66 of first terminals 61. Moreover, tail portions 162 are bent to be connected to holding portions 163 and extend outwardly in the width direction of second housing 111, connected to connection pads connected to a conductive trace on the second board. Connection portions 164 are bent to be connected to holding portions 163 and extend toward the inner side in the width direction of second housing 111. First contact portions 165 are portions that are bent to be connected to inner ends of connection portions 164 and extend downwardly and contact first contact portions 65 of first terminals 61.

Furthermore, convex contact portions 166, configured to engage second contact portions 66 of first terminals 61, are formed in the vicinity of the upper ends of holding portions 163. Convex contact portions 166 are formed within a range of areas extending from the outer ends of connection portions 164 to the vicinity of the upper ends of holding portions 163, and include curved portions 164*a*, which are boundaries of connection portions 164, and holding portions 163. Specifically, convex contact portions 166 are formed to bulge outwardly from surfaces of holding portions 163 and curved portions 164*a* in response to pressing, from an opposite side, of the metal plate which forms second terminals 161.

Figure 8:
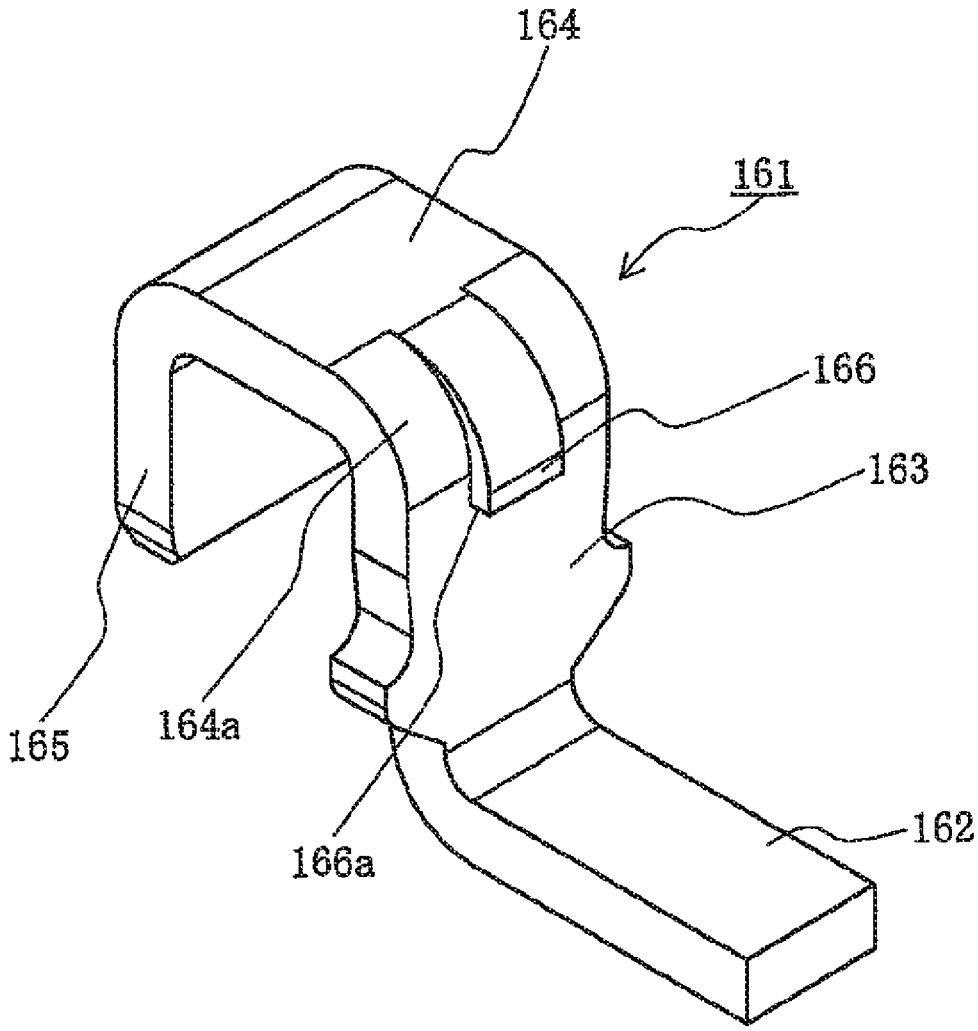
FIG. 8 is a first perspective view of the second terminal of the board-to-board connector according to the embodiment of the Present Disclosure.

As illustrated in FIG. 8, the amount of bulging of convex contact portions 166 increases gradually as they go from connection portions 164 toward holding portions 163. Moreover, although the surfaces of convex contact portions 166 are smoothly connected with the surfaces of connection portions 164, the surfaces are connected with the surfaces of holding portions 163 and curved portions 164*a* via a steep wall surface. Moreover, convex edge portions 166*a*, which are steep wall surfaces, are formed at positions where the lower ends of the surfaces of convex contact portions 166 are connected with the surfaces of holding portions 163. Convex edge portions 166*a* are extreme end portions of convex contact portions 166, and are preferably steep enough to be approximately perpendicular to the surfaces of holding portions 163.

Moreover, concave contact portions 165*a*, configured to engage first contact portions 65 of first terminals 61, are formed on the surfaces of first contact portions 165. Specifically, concave contact portions 165*a* are formed so as to be recessed from the surfaces of first contact portions 165 in response to pressing, from a surface side of first contact portions 165, of the metal plate which forms second terminals 161.

Figure 9:
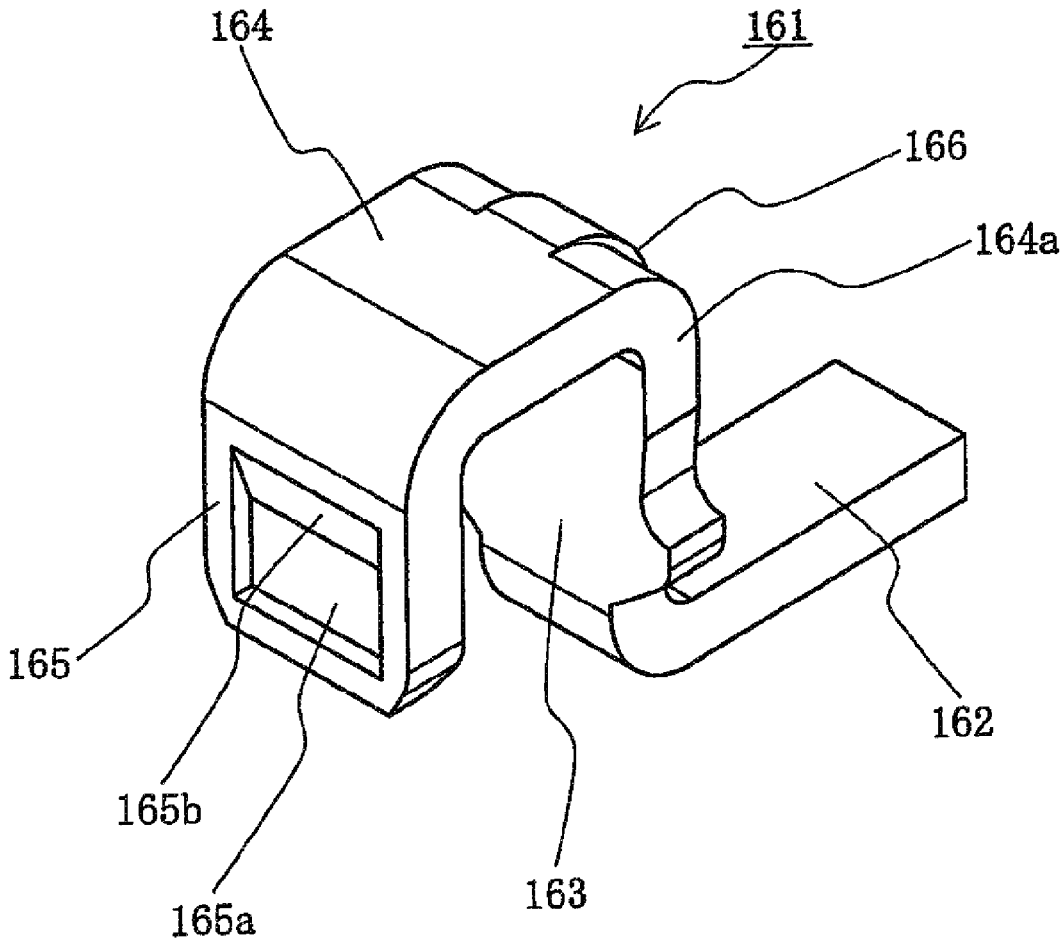
FIG. 9 is a second perspective view of the second terminal of FIG. 8.

As illustrated in FIG. 9, although concave contact portions 165*a* have flat bottom surfaces which are approximately parallel with the surfaces of first contact portions 165, they are connected with the surfaces of first contact portions 165 via a steep wall surface. Moreover, concave edge portions 165*b*, which are steep wall surfaces, are formed at positions where upper ends of the bottom surfaces of concave contact portions 165*a* are connected with the surfaces of first contact portions 165. Concave edge portions 165*b* are starting end portions of concave contact portions 165*a*, and are preferably steep enough to be approximately perpendicular to the surfaces of first contact portions 165.

The relative positional relationship between convex contact portions 166 and concave contact portions 165*a* in the up-down direction is set such that when first connector 1 and second connector 101 are engaged by fitting together, a timing at which first convex contact portions 65*a* of first terminals 61 which are moved while making abutting contact with the surfaces of first contact portions 165 reach concave edge portions 165*b* to be received in concave contact portions 165*a* takes place at the same time with or immediately after a timing at which second convex contact portions 66*a* of first terminals 61 which are moved while making abutting contact with the surfaces of convex contact portions 166 reach convex edge portions 166*a* to be displaced toward the surfaces of holding portions 163 by being released from a state of being in abutting contact with the surfaces of second convex contact portions 66*a*.

Therefore, for example, when first convex contact portions 65*a* and second convex contact portions 66*a* of first terminals 61 are at the same position with respect to the up-down direction, the positions of concave edge portions 165*b* are set such that they are located at the same position with convex edge portions 166*a* with respect to the up-down direction or to be lower than convex edge portions 166*a*. If first convex contact portions 65*a* and second convex contact portions 66*a* are not at the same position with respect to the up-down direction, the relative positional relationship between concave edge portions 165*b* and convex edge portions 166*a* is appropriately set to comply with the positions of the respective convex contact portions.

Furthermore, second protrusive end portions 122 as a second fitting guide portion are arranged at both ends in the longitudinal direction of second housing 111, respectively. Each of second protrusive end portions 122 is a thick member that extends in the short-axis direction of second housing 111 and has both ends thereof connected to both ends in the longitudinal direction of second protrusive convex portion 112, and upper surface 122*a* thereof is a generally rectangular flat surface. Moreover, second protrusive end portions 122 are portions in which concave protrusive end portions 22 of first protrusive end portions 21 of first connector 1 are inserted in a state where first connector 1 and second connector 101 are engaged by fitting together.

Furthermore, second reinforcing brackets 151 as a reinforcing bracket are attached to second protrusive end portions 122. Second reinforcing brackets 151 are an integral member formed by applying processing, e.g., punching and bending, to a metal plate and are received and held in second concave bracket holding portions 126 formed in second protrusive end portion 122. Moreover, tail portions 152 formed at the lower ends of second reinforcing brackets 151 are connected to fixing pads on the second board by means of soldering or the like. Furthermore, convex engagement portions 153 formed at the upper ends of tail portions 152 are configured to be engaged with convex engagement portions 53 of first reinforcing brackets 51 of first connector 1 in a state where first connector 1 and second connector 101 are engaged by fitting together with each other.

Figure 3:
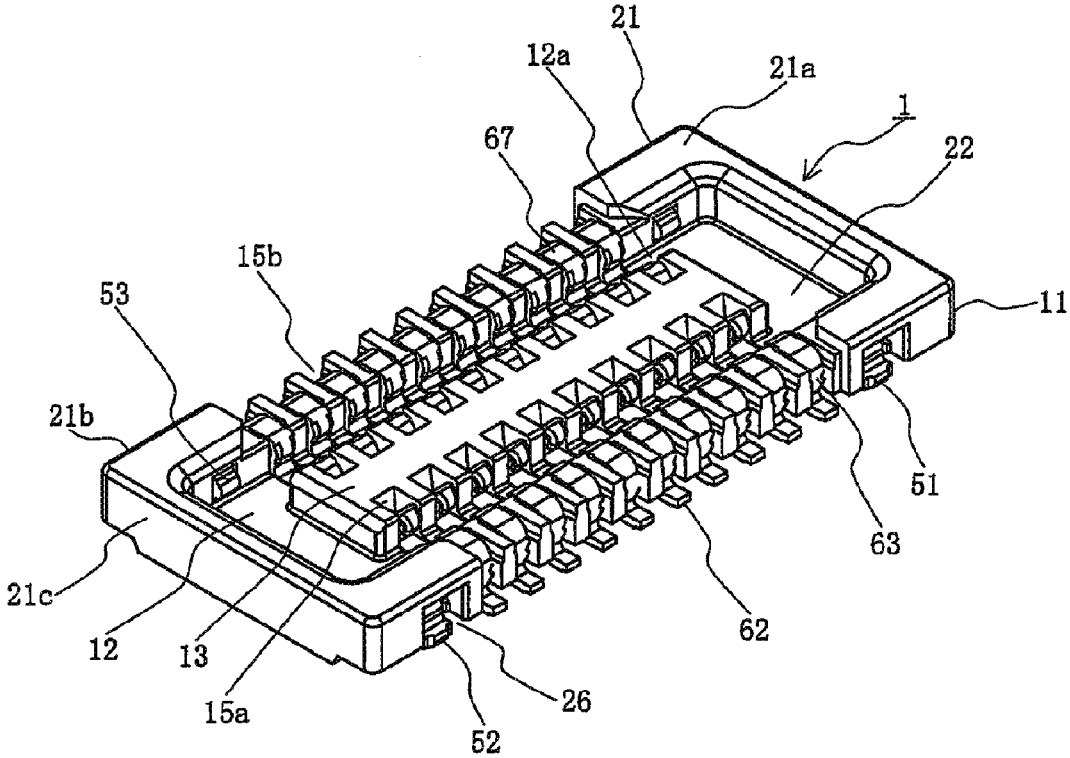
FIG. 3 is a perspective view of the connector of FIG. 1.
Figure 10:
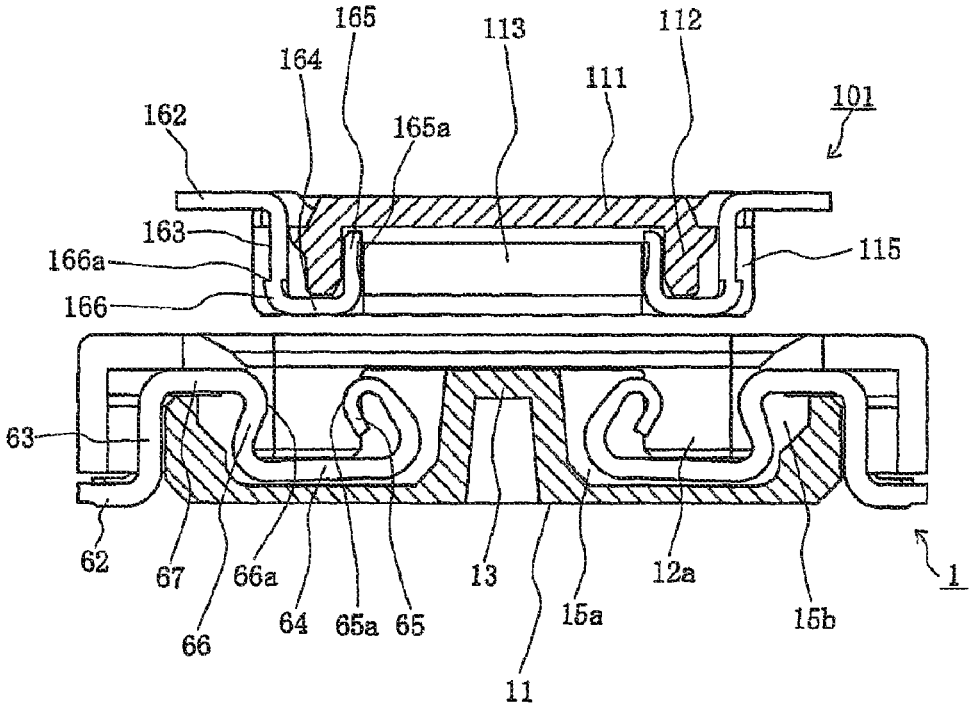
FIG. 10 is a cross-sectional view of the terminals of the connectors of FIGS. 4 and 8, illustrating a first step of a fitting operation.

FIGS. 10-3 provide an illustration of an operation of fitting first connector 1 and second connector 101 having the above-mentioned structure to be engaged with each other. In this embodiment, first connector 1 is assumed to be surface-mounted on the first board in a state where tail portions 62 of first terminals 61 are connected to the non-illustrated connection pads connected to a conductive trace on the first board by means of soldering or the like and tail portions 52 of first reinforcing brackets 51 are connected to the fixing pads on the first board by means of soldering or the like.

As illustrated in FIG. 10, first convex contact portions 65*a* which are the most protruding portions of the front ends of first contact portions 65 protrude from first terminal-receiving inside cavities 15*a* of first convex portions 13 to be received in recessed groove portions 12*a*. On the other hand, at least second convex contact portions 66*a* which are the most protruding portions of second contact portions 66 protrude from first terminal-receiving outside cavities 15*b* of side wall portions 14 to be received in recessed groove portions 12*a*.

Figure 13:
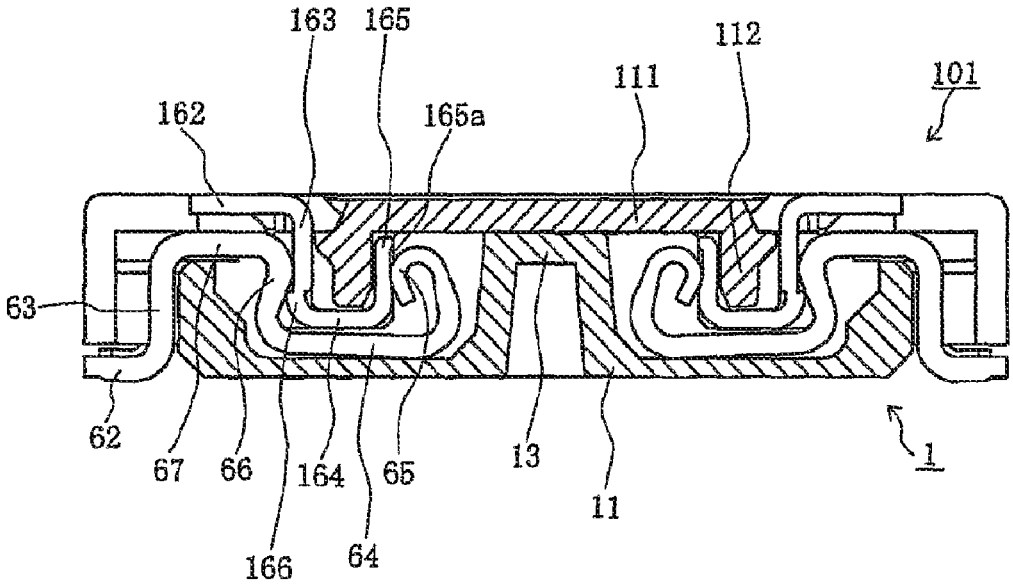
FIG. 13 is a cross-sectional view of the terminals of the connectors of FIGS. 4 and 8, illustrating a state where the connectors are engaged together, by fitting.
Figure 14:
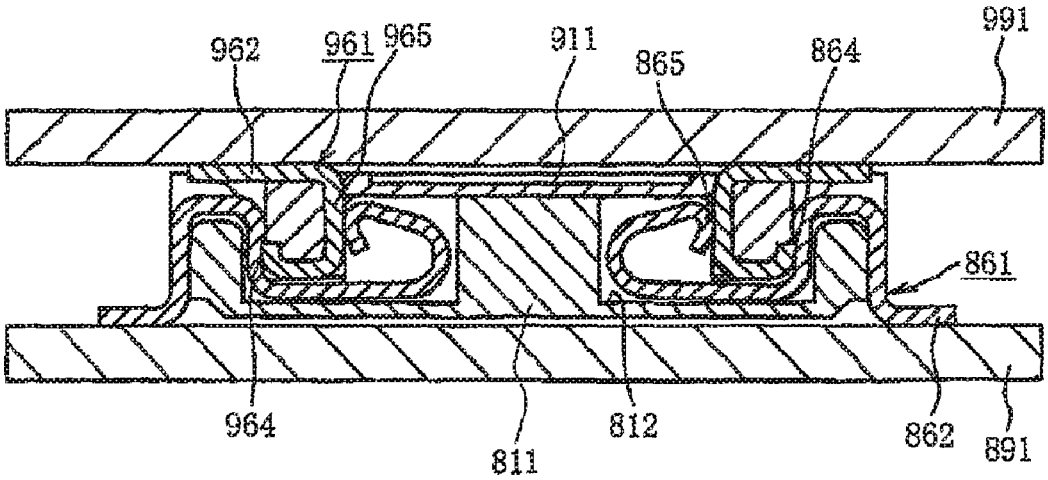
FIG. 14 PRIOR ART
FIG. 14 is a cross-sectional view of a conventional board-to-board connector.

Owing to this configuration, as illustrated in FIG. 13, in a state where first connector 1 and second connector 101 are engaged by fitting together, second terminals 161 of second connector 101 inserted into recessed groove portions 12*a* can be clamped by first contact portions 65 and second contact portions 66 opposing each other in a sandwich manner. Moreover, in the example illustrated in the drawing figures, although first convex contact portions 65*a* and second convex contact portions 66*a* are at the same position with respect to the thickness direction, namely, the up-down direction of first housing 11, they need not necessarily be at the same position but may be positioned at different positions with respect to the up-down direction.

Similarly, second connector 101 is assumed to be surface-mounted on the second board in a state where tail portions 162 of second terminals 161 are connected to the non-illustrated connection pads connected to a conductive trace on the second board by means of soldering or the like and tail portions 152 of second reinforcing brackets 151 are connected to the fixing pads on the second board by means of soldering or the like.

As illustrated in FIG. 10, first contact portions 165 are arranged to be exposed while extending along the inner side walls of second protrusive convex portions 112, and holding portions 163 are positioned inside second terminal receiving cavities 115. Moreover, concave contact portions 165*a* are formed on the surfaces of first contact portions 165 to be recessed from the surfaces. Furthermore, convex contact portions 166 are formed in the vicinity of the upper ends (the lower ends in the position and attitude of second connector 101 illustrated in FIGS. 10-3) of holding portions 163, and the surfaces of holding portions 163 being located on the lower side (the upper side in the position and attitude of second connector 101 illustrated in FIGS. 10-3) of convex edge portions 166*a* are recessed more than the surfaces of convex contact portions 166.

Owing to this configuration, as illustrated in FIG. 13, in a state where first connector 1 and second connector 101 are engaged by fitting together, first contact portions 165 and holding portions 163 of second terminals 161 of second connector 101, inserted in recessed groove portions 12*a* can make contact with first contact portions 65 and second contact portions 66 of first terminals 61, respectively, in which first and second contact portions 65, 66 clamp second terminals 161 in a sandwich manner. More specifically, first convex contact portions 65*a* make contact with the bottom surfaces of concave contact portions 165*a*, and second convex contact portions 66*a* make contact with the surfaces of holding portions 163 on a lower side of convex edge portions 166*a*.

In this embodiment, since first connector 1 and second connector 101 are mounted on the first board and the second board which have a large area, respectively, it will be described that an operator performs a fumbling operation for fitting in a state of being unable to visually recognize the fitting face of first connector 1 and the fitting face of second connector 101.

First, as illustrated in FIG. 10, the operator manipulates the connectors so that the fitting face of first connector 1 opposes the fitting face of second connector 101. When the positions of second protrusive convex portions 112 on the left and right sides of second connector 101 correspond to the positions of recessed groove portions 12*a* on the left and right sides of first connector 1, the positioning between first connector 1 and second connector 101 is completed.

Figure 11:
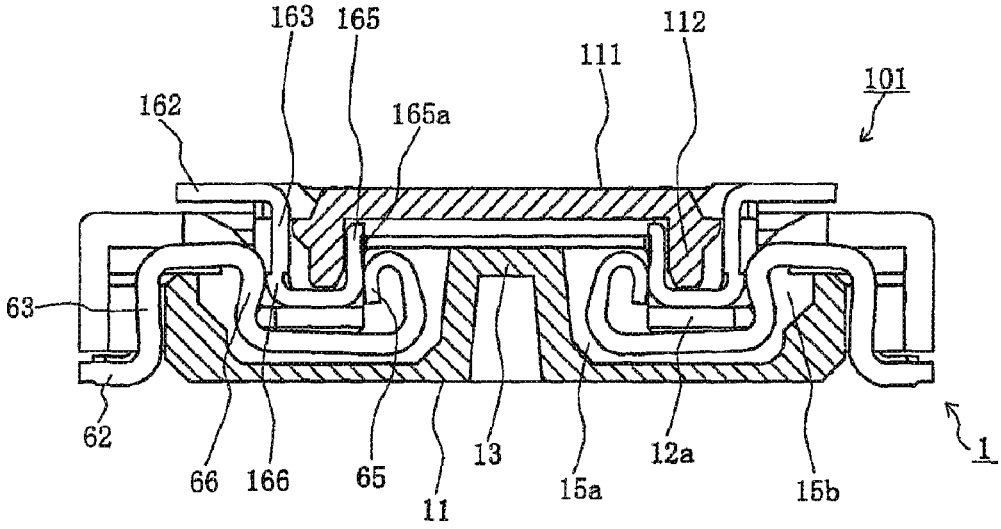
FIG. 11 is a cross-sectional view of the terminals of the connectors of FIGS. 4 and 8, illustrating a second step of the fitting operation.

In such a state, when the operator moves first connector 1 and/or second connector 101 in a direction toward either one of the connectors, i.e., in the fitting direction, second protrusive convex portions 112 on the left and right sides of second connector 101 are received in recessed groove portions 12*a* on the left and right sides of first connector 1 as illustrated in FIG. 11. Moreover, second terminals 161 of second connector 101 are inserted to be positioned between first contact portions 65 and second contact portions 66 of first terminals 61, so that first contact portions 65 of first terminals 61 are brought into contact with first contact portions 165 of second terminals 161, and second contact portions 66 of first terminals 61 are brought into contact with convex contact portions 166 of second terminals 161.

In this way, the gap between first contact portions 65 and second contact portions 66 is elastically increased by pressing of second terminals 161. On the other hand, in second terminals 161, holding portions 163 are held by being fitted in second terminal receiving cavities 115, and the rear surfaces of first contact portions 165 are in abutting or close contact with the bottom surfaces of second terminal receiving cavities 115. Therefore, the gap between holding portions 163 and first contact portions 165 is almost kept unchanged.

In the state illustrated in FIG. 11, first convex contact portions 65*a* of first terminals 61 are in abutting contact with the surfaces of first contact portions 165 of second terminals 161, and second convex contact portions 66*a* of first terminals 61 are in abutting contact with the surfaces of convex contact portions 166 of second terminals 161. As described above, since convex contact portions 166 are formed so as to bulge outwardly from the surfaces of holding portions 163, when second convex contact portions 66*a* make abutting contact with the surfaces of convex contact portions 166, the gap between first contact portions 65 and second contact portions 66 of first terminals 61 can be increased more than that when second convex contact portions 66*a* make contact with the surfaces of holding portions 163. Therefore, a stronger spring force can be produced by first terminals 61 as a repulsive force to the elastically increasing gap between first contact portions 65 and second contact portions 66. As a result, an insertion force required for inserting second terminals 161 of second connector 101 to be positioned between first contact portions 65 and second contact portions 66 of first terminals 61, and an insertion force, which is the sum of the above-mentioned insertion force, required for inserting second protrusive convex portions 112 on the left and right sides of second connector 101 to be received in recessed groove portions 12*a* on the left and right sides of first connector 1 are also increased more.

That is, in the present embodiment, since second terminals 161 are provided with convex contact portions 166, the insertion force needed when first connector 1 and second connector 101 are engaged by fitting together is increased compared with the case where convex contact portions 166 are not provided. Moreover, in the state illustrated in FIG. 11, second convex contact portions 66*a* make abutting contact with the surfaces of convex contact portions 166. Therefore, in the step of fitting first connector 1 and second connector 101 to be engaged together, the gap between first contact portions 65 and second contact portions 66 of first terminals 61 becomes the maximum, and thus, the insertion force reaches the maximum value.

Figure 12:
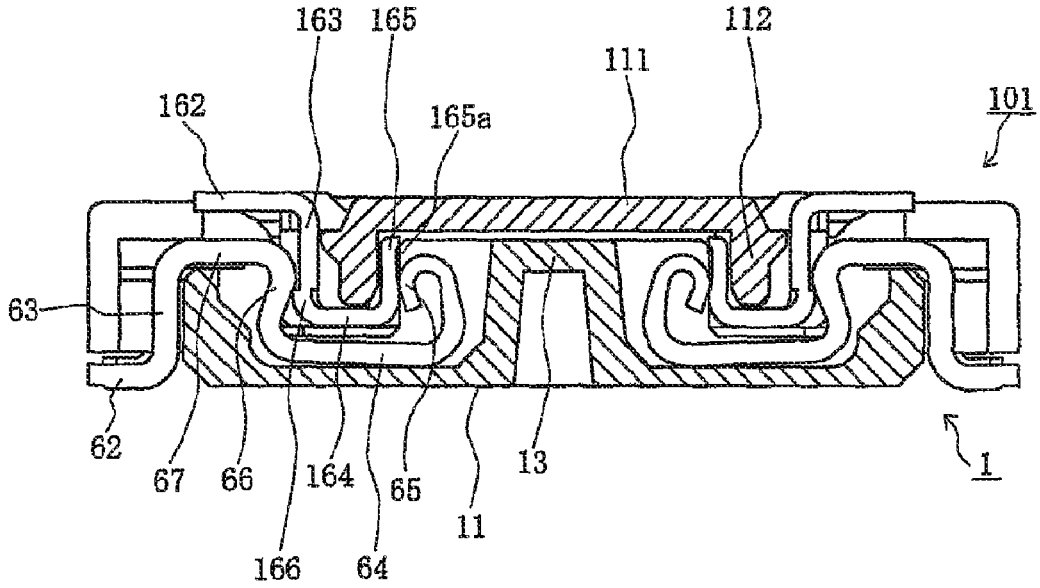
FIG. 12 is a cross-sectional view of the terminals of the connectors of FIGS. 4 and 8, illustrating a third step of the fitting operation.

Subsequently, when the operator further moves second connector 101 in the fitting direction relative to first connector 1, as illustrated in FIG. 12, second convex contact portions 66*a* of first terminals 61 pass convex edge portions 166*a* of second terminal 161 to be separated from the surfaces of convex contact portions 166 and displaced toward the surfaces of holding portions 163 (i.e., second convex contact portions 66*a* are displaced in the direction for approaching the opposing ones of first convex contact portions 65*a*). In this case, since convex edge portions 166*a* are steep wall surfaces, second convex contact portions 66*a* are displaced abruptly. Therefore, the gap between first contact portions 65 and second contact portions 66 is decreased abruptly, and the spring force exerted by first terminals 61 is decreased abruptly. As a result, the insertion force decreases abruptly from the maximum values, and thus, the operator is able to perceive the abrupt decrease in the insertion force by a sense of a strong click-feeling.

Moreover, as described above, the relative positional relationship between convex contact portions 166 and concave contact portions 165*a* of second connector 101 in the up-down direction is set such that a timing at which first convex contact portions 65*a* of first terminals 61 which are moved while making abutting contact with the surfaces of first contact portions 165 reach concave edge portions 165*b* to be received in concave contact portions 165*a* takes place at the same time with or immediately after a timing at which second convex contact portions 66*a* of first terminals 61 which are moved while making abutting contact with the surfaces of convex contact portions 166 reach convex edge portions 166*a* to be displaced toward the surfaces of holding portions 163 by being released from a state of being in abutting contact with the surfaces of second convex contact portions 66*a*.

Therefore, when second convex contact portions 66*a* are displaced toward the surfaces of holding portions 163, first convex contact portions 65*a* are displaced toward the bottom surfaces of concave contact portions 165*a* at the same time with or immediately after the displacement (i.e., first convex contact portions 65*a* are displaced in the direction for approaching the opposing ones of second convex contact portions 66*a*). Therefore, the gap between first contact portions 65 and second contact portions 66 is decreased further abruptly, and the spring force exerted by first terminals 61 is decreased further abruptly. As a result, the insertion force decreases further abruptly, and thus, the operator is able to perceive the further abrupt decrease in the insertion force by a sense of a stronger click-feeling.

Subsequently, when the operator further moves second connector 101 in the fitting direction relative to first connector 1, as illustrated in FIG. 13, the fitting engagement between first connector 1 and second connector 101 is completed. In this case, second convex contact portions 66*a* of first terminals 61 are in abutting contact with the surfaces of holding portions 163 on a lower side (the upper side in the position and attitude of second connector 101 illustrated in FIGS. 10-3) of convex edge portions 166*a* of second terminals 161, and second contact portions 66 are engaged with convex contact portions 166. Moreover, first convex contact portions 65*a* of first terminals 61 are in abutting contact with the bottom surfaces of concave contact portions 165*a*, and first contact portions 65 are engaged with concave contact portions 165*a*.

In this way, first contact portions 65 of first terminals 61 make contact with first contact portions 165 of second terminals 161, and second contact portions 66 of first terminals 61 make contact with holding portions 163 of second terminals 161, whereby first terminals 61 and second terminals 161 are electrically connected to each other. As a result, the conductive trace connected to the connection pads on the first board being connected to tail portions 62 of first terminals 61 are electrically connected to the conductive trace connected to the connection pads on the second board being connected to tail portions 162 of second terminals 161. In this case, since first contact portions 65 are pressed against first contact portions 165 and second contact portions 66 are pressed against holding portions 163 by the spring force exerted by first terminals 61, it is possible to certainly maintain stable electrical connection. Moreover, since first terminals 61 and second terminals 161 make multi-point contact with each other, it is possible to more certainly maintain stable electrical connection.

Moreover, first contact portions 65 of first terminals 61 are engaged with concave contact portions 165*a* of second terminals 161, and second contact portions 66 of first terminals 61 are engaged with convex contact portions 166 of second terminals 161. Furthermore, convex engagement portions 53 of first reinforcing brackets 51 of first connector 1 are engaged with concave engagement portions 153 of second reinforcing brackets 151 of second connector 101. Owing to this configuration, it is difficult to remove second connector 101 from first connector 1 even upon receipt of a force that releases the fitting engagement between first connector 1 and second connector 101, that is, upon receipt of a removal force for removing second connector 101 from first connector 1. That is, a necessary removal force is increased.

Furthermore, since first terminals 61 have elastic properties, the gap between first contact portions 65 and second contact portions 66 can be increased by pressing second terminals 161 to be positioned between them. Moreover, the upper end portions of first contact portions 65 and second contact portions 66 have a curved surface shape that is outwardly opened, and thus, the gap between first contact portions 65 and second contact portions 66 increases as it goes upward. In addition, the connecting portions of connection portions 164 of second terminals 161 and holding portions 163 and first contact portions 165 have a curved surface shape. Owing to such a configuration, even when first terminals 61 and second terminals 161 are misaligned to some extent in the left-right direction, when second connector 101 is moved downward, second terminals 161 are caused to smoothly come to be positioned between first contact portions 65 and second contact portions 66 of first terminals 61 and are thus automatically aligned. That is, self-alignment is carried out.

Furthermore, although the present embodiment has been described with respect to an example of second terminals 161 in which concave contact portions 165*a* are formed in first contact portions 165 and convex contact portions 166 are formed in holding portions 163, convex contact portions 166 may be formed in first contact portions 165 and concave contact portions 165*a* may be formed in holding portions 163.

As described above, in the present embodiment, when second protrusive convex portions 112 of second connector 101 are inserted in recessed groove portions 12*a* of first connector 1, the mutual gap between first contact portions 65 and second contact portions 66 of first terminals 61 is increased by pressing of second terminals 161 and is then decreased. Owing to such a configuration, since a strong click-feeling can be perceived, even when a fitting operation of the connectors is performed in a fumbling manner, an operator is able to certainly recognize the completion of fitting engagement. Therefore, the fitting operation can be completed in a short period of time and in an accurate manner. Accordingly, it is possible to realize good operability and high reliability of the board-to-board connector.

Moreover, in the present embodiment, either one of first contact portions 165 and holding portions 163 of second terminals 161 are provided with convex contact portions 166 which are configured to protrude from respective surfaces thereof, and the other contact portions are provided with concave contact portions 165*a* which are configured to be recessed from respective surfaces thereof. Owing to such a configuration, since the gap between first contact portions 65 and second contact portions 66 is increased and then decreased abruptly, the insertion force increases and then decreased abruptly. Therefore, the operator is able to perceive the abrupt decrease after increase in the insertion force by a sense of a strong click-feeling.

Furthermore, in the present embodiment, when second protrusive convex portions 112 of second connector 101 are inserted in recessed groove portions 12*a* of first connector 1, a timing at which any one of first contact portions 65 and second contact portions 66 of first terminals 61 reach concave edge portions 165*b* of concave contact portions 165*a* takes place at the same time with or immediately after a timing at which the other contact portions reach convex edge portions 166*a* of convex contact portions 166. Owing to such a configuration, the gap between first contact portions 65 and second contact portions 66 is decreased further abruptly, and the spring force exerted by first terminals 61 is decreased further abruptly. Accordingly, the operator is able to perceive a stronger click-feeling.

While a preferred embodiment of the Present Disclosure is shown and described, it is envisioned that those skilled in the art may devise various modifications without departing from the spirit and scope of the foregoing Description and the appended Claims.

What is claimed is:

1. A board-to-board connector comprising:

a first connector, the first connector including concave insertion portions in which first terminals are arranged; and a second connector, the second connector being configured to engage the first connector, the second connector including convex insertion portions in which second terminals are arranged and which are inserted in the concave insertion portions;

wherein:

each first terminal is provided with a first contact portion, arranged on one side face of each concave insertion portion, and a second contact portion, arranged on the other side face of each concave insertion portion;

each second terminal is provided with a first contact portion, arranged on one side face of each convex insertion portion so as to extend in an insertion direction of the convex insertion portion and configured to contact the first contact portion of each first terminal, the first contact portion including a concave contact portion recessed from the surface thereof, and a second contact portion, arranged on the other side face of each convex insertion portion, so as to extend in the insertion direction of the convex insertion portion and configured to contact the second contact portion of each first terminal; and when each convex insertion portion is inserted in one of the concave insertion portions, a mutual gap between the first contact portion and the second contact portion of each first terminal is increased due to pressing of a respective second terminal, and is then decreased when the first contact portion of each first terminal is received in the concave portion of each second terminal.

2. The board-to-board connector according to claim 1, wherein an insertion force, needed when each convex insertion portion is inserted in one of the concave insertion portions, increases and then decreases abruptly in response to the mutual gap between the first contact portion and the second contact portion of each first terminal.

3. The board-to-board connector according to claim 1, wherein the second contact portion of each second terminal is provided with a convex contact portion, configured to protrude from a surface thereof.

4. The board-to-board connector according to claim 3, wherein an insertion force, needed when each convex insertion portion is inserted in one of the concave insertion portions, increases and then decreases abruptly in response to the mutual gap between the first contact portion and the second contact portion of each first terminal.

5. The board-to-board connector according to claim 3, wherein when each convex insertion portion is inserted into one of the concave insertion portions, a timing, at which one of the first contact portion and the second contact portion of the first terminal reaches a starting end portion of the concave contact portion, takes place at the same time with or immediately after a timing, at which the other contact portion reaches an extreme end portion of the convex contact portion.

6. The board-to-board connector according to claim 5, wherein an insertion force, needed when each convex insertion portion is inserted in one of the concave insertion portions, increases and then decreases abruptly in response to the mutual gap between the first contact portion and the second contact portion of each first terminal.

7. The board-to-board connector according to claim 5, wherein an insertion force, needed when each convex insertion portion is inserted in one of the concave insertion portions, decreases from its maximum value when one of the first contact portion and the second contact portion of the first terminal passes the extreme end portion.

* * * * *